US010724762B2

(12) United States Patent
Deivasigamani et al.

(10) Patent No.: US 10,724,762 B2
(45) Date of Patent: Jul. 28, 2020

(54) HEAT EXCHANGER INCLUDING FLUE FLOW PATH GUIDE SYSTEM

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 189 days.

(21) Appl. No.: 16/004,331

(22) Filed: Jun. 8, 2018

(65) Prior Publication Data

US 2019/0376725 A1 Dec. 12, 2019

(51) Int. Cl.

| | |
|---|---|
| ***F24H 1/16*** | (2006.01) |
| ***F24H 1/20*** | (2006.01) |
| ***F24H 9/18*** | (2006.01) |
| ***F24H 9/14*** | (2006.01) |
| ***F24H 9/00*** | (2006.01) |

(52) U.S. Cl.

CPC ..... *F24H 1/205* (2013.01); *F24H 9/0026* (2013.01); *F24H 9/146* (2013.01); *F24H 9/1836* (2013.01)

(58) Field of Classification Search

CPC ... F24H 1/14; F24H 1/16; F24H 1/165; F24H 1/43

See application file for complete search history.

(56) References Cited

U.S. PATENT DOCUMENTS

| | | | | |
|---|---|---|---|---|
| 3,910,255 | A * | 10/1975 | Sharer | F24H 1/0045 122/18.4 |
| 4,044,727 | A * | 8/1977 | Rychen | F23B 1/38 122/449 |
| 6,401,669 | B1 * | 6/2002 | Macgowan | F24H 1/43 122/406.1 |
| 10,012,413 | B2 * | 7/2018 | Li | F24H 8/00 |
| 10,495,343 | B2 * | 12/2019 | Jacques | F24H 1/43 |
| 2017/0284702 | A1 * | 10/2017 | Boros | F24H 4/02 |
| 2019/0301770 | A1 * | 10/2019 | Hecimovich | F23L 5/02 |

* cited by examiner

*Primary Examiner* — Gregory A Wilson

(74) *Attorney, Agent, or Firm* — Tracy Jong Law Firm; Tracy P. Jong; Cheng Ning Jong

(57) ABSTRACT

A guide system including a top end, a bottom end, a lumen and a plurality of openings, the system is disposed within a coil lumen at the bottom end of the heat exchanger coil with the bottom end of the system extending beyond the bottom end of the coil in a direction from the top end to the bottom end of the coil, the system configured in a shape of the coil lumen and the openings are disposed on the bottom end of the system, wherein the heat exchanger is configured to channel the flue flow from a burner through a path to heat a fluid flow of the coil before entering the lumen of the system via the openings to avoid a pressure drop due to a tendency for the flue flow to follow a path defined by a shape of the bottom end of the coil.

11 Claims, 10 Drawing Sheets

HEAT EXCHANGER INCLUDING FLUE FLOW PATH GUIDE SYSTEM

BACKGROUND OF THE INVENTION

1. The Field of the Invention

The present invention relates to a flue flow path guide system. More specifically, the present invention is directed to a flue flow path guide system adapted to evenly direct flue flow to coil loops of the downstream end of a coil of a heat exchanger.

2. Background Art

In a conventional coil tube heat exchanger of a water heater, no considerations are made to reduce the pressure drop of the flue flow in its path out of the heater in which the coil tube heat exchanger is disposed. As such, a large blower is required to push the flue flow through the heat exchanger, increasing not only the procurement and replacement costs and power consumption, but also the noise level. There arises a need to reduce the pressure drop in the flue flow of a coil tube heat exchanger such that a smaller and less costly and demanding blower may be used.

SUMMARY OF THE INVENTION

In accordance with the present invention, there is provided a guide system for guiding a flue flow of a heat exchanger configured for heating a fluid flow, the heat exchanger having a coil having a top section, a bottom section, a top end, a bottom end and a lumen, the coil configured for receiving the fluid flow at one of the top end and bottom end of the coil and channeling the flow to the other one of the top end and bottom end, a burner disposed at the top section of the coil within the lumen of the coil, the burner configured to receive an air-fuel flow urging a flue flow of the burner in a direction from the top end of the coil to the bottom end of the coil, a housing within which the coil is disposed, an open-bottom and closed-top tube configured in a shape of the lumen of the coil, the closed-top tube disposed at the bottom section of the coil within the lumen of the coil to cooperatively form a path with the housing within which the bottom section of the coil is disposed, the guide system including a top end, a bottom end, a lumen and a plurality of openings, the guide system is disposed within the lumen of the coil at the bottom end of the coil with the bottom end of the guide system extending beyond the bottom end of the coil in a direction from the top end of the coil to the bottom end of the coil, the guide system is configured in a shape of the lumen of the coil and the plurality of openings are disposed on the bottom end of the guide system, wherein the heat exchanger is configured to channel the flue flow from the burner through the path to heat the fluid flow before the flue flow entering the lumen of the guide system via the plurality of openings to avoid a pressure drop due to a tendency for the flue flow to follow a route defined by a shape of the bottom end of the coil.

In accordance with the present invention, there is provided a heat exchanger for heating a fluid flow, the heat exchanger including:

(a) a coil including a top section, a bottom section, a top end, a bottom end and a lumen, the coil configured for receiving the fluid flow at one of the top end and bottom end of the coil and channeling the fluid flow to the other one of the top end and bottom end;

(b) a burner disposed at the top section within the lumen of the coil, the burner configured to receive an air-fuel flow urging a flue flow of the burner in a direction from the top end of the coil to the bottom end of the coil;

(c) a housing within which the coil is disposed;

(d) an open-bottom and closed-top tube configured in a shape of the lumen of the coil, the tube disposed at the bottom section within the lumen of the coil to cooperatively form a path with the housing within which the bottom section of the coil is disposed; and (e) a guide system including a top end, a bottom end, a lumen and a plurality of openings, the guide system disposed within the lumen at the bottom end of the coil with the bottom end of the guide system extending beyond the bottom end of the coil in a direction from the top end of the coil to the bottom end of the coil, wherein the guide system is configured in a shape of the lumen of the coil and the plurality of openings are disposed on the bottom end of the guide system, wherein the heat exchanger is configured to channel the flue flow from the burner through the path to heat the fluid flow before entering the lumen of the guide system via the plurality of openings to avoid a pressure drop due to a tendency for the flue flow to follow a route defined by a shape of the bottom end of the coil.

In one embodiment, the plurality of openings of the guide system includes cutouts made on the bottom end of the guide system.

In one embodiment, the plurality of openings of the guide system includes a plurality of legs upon which the closed-top tube is supported.

In one embodiment, the heat exchanger further includes a heat shield disposed atop the closed-top tube to prevent overheating of a top portion of the closed-top tube.

In one embodiment, the plurality of openings are configured to vary in size along a periphery of the bottom end of the guide system.

In one embodiment, the heat shield includes a ceramic material.

In one embodiment, there is further provided a guide system for guiding a flue flow of a heat exchanger configured for heating a fluid flow, the heat exchanger having a coil having a top section, a bottom section, a top end, a bottom end and a lumen, the coil configured for receiving the fluid flow at one of the top end and bottom end of the coil and channeling the flow to the other one of the top end and bottom end, a burner disposed at the top section of the coil within the lumen of the coil, the burner configured to receive an air-fuel flow urging a flue flow of the burner in a direction from the top end of the coil to the bottom end of the coil, a housing within which the coil is disposed, an open-bottom and closed-top tube configured in a shape of the lumen of the coil, the closed-top tube disposed at the bottom section of the coil within the lumen of the coil to cooperatively form a path with the housing within which the bottom section of the coil is disposed, the guide system including a top end, a bottom end, a lumen and at least one aperture, the guide system is disposed within the lumen of the coil at the bottom end of the coil with the bottom end of the guide system extending beyond the bottom end of the coil in a direction from the top end of the coil to the bottom end of the coil, the guide system is configured in a shape of the lumen of the coil and the at least one aperture disposed between the top end and the bottom end of the guide system for allowing the flue flow to enter the lumen of the guide system from the path, wherein the heat exchanger is configured to channel the flue flow from the burner through the path to heat the fluid flow before entering the lumen of the guide system via the at least one aperture to avoid a pressure drop due to a tendency for the flue flow to follow a route defined by a shape of the bottom end of the coil.

In one embodiment, at least one of the plurality of apertures is aligned with an interface between at least one set of two consecutive coil loops of the coil.

An object of the present invention is to provide a device capable of evenly distributing a flue flow commensurate with and over the outer surfaces of a heat transfer coil.

Another object of the present invention is to provide a passive device capable of evenly distributing a flue flow commensurate with and over the outer surfaces of a heat transfer coil.

Another object of the present invention is to provide a device capable of reducing the pressure drop associated with a flue flow tracing a loop, e.g., the last loop of a coil in the flue flow exhaust of a heat exchanger.

Another object of the present invention is to provide a device capable of equalizing the pressure drop associated with a flue flow about the periphery of the lumen of a heat exchanger.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—heat exchanger
4—lumen of coil
6—flow of fluid to be heated
8—coil
10—housing
12—open-bottom and closed-top tube
14—guide system
16—lumen of guide system
18—opening
20—aperture
22—cutout
24—leg
26—burner
28—heat shield
30—blower
32—flue flow
34—structure
36—last or most downstream loop of coil
38—notch
40—locator
42—edge of tube
44—edge of tube
46—average height of opening
48—average height of opening
50—exhaust
52—right seam
54—left seam
56—air-fuel mixture flow caused by blower

PARTICULAR ADVANTAGES OF THE INVENTION

The present guide reduces the pressure drop of a flue gas flow by allowing flue gas to enter a centrally located space directly without having to trace a longer path along the last loop of a coil that causes an undesired pressure drop in the flue flow. In one embodiment, the present guide system also enhances heat transfer from a flue gas flow to a coil by having apertures suitably aligned with the interfaces between consecutive coil loops the coil.

In one embodiment, the present guide may be constructed from a rectangular-shaped flat sheet with cutouts and subsequently joined with any suitable joining techniques at a seam or from a tube-shaped component with cutouts, thereby removing the need for forming a component in numerous steps or with advanced manufacturing techniques and tools. In one embodiment, the present guide system may be constructed simply as a cylinder or tube that is supported on legs formed at the bottom portion of a housing of the burner within which the cylinder is disposed.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
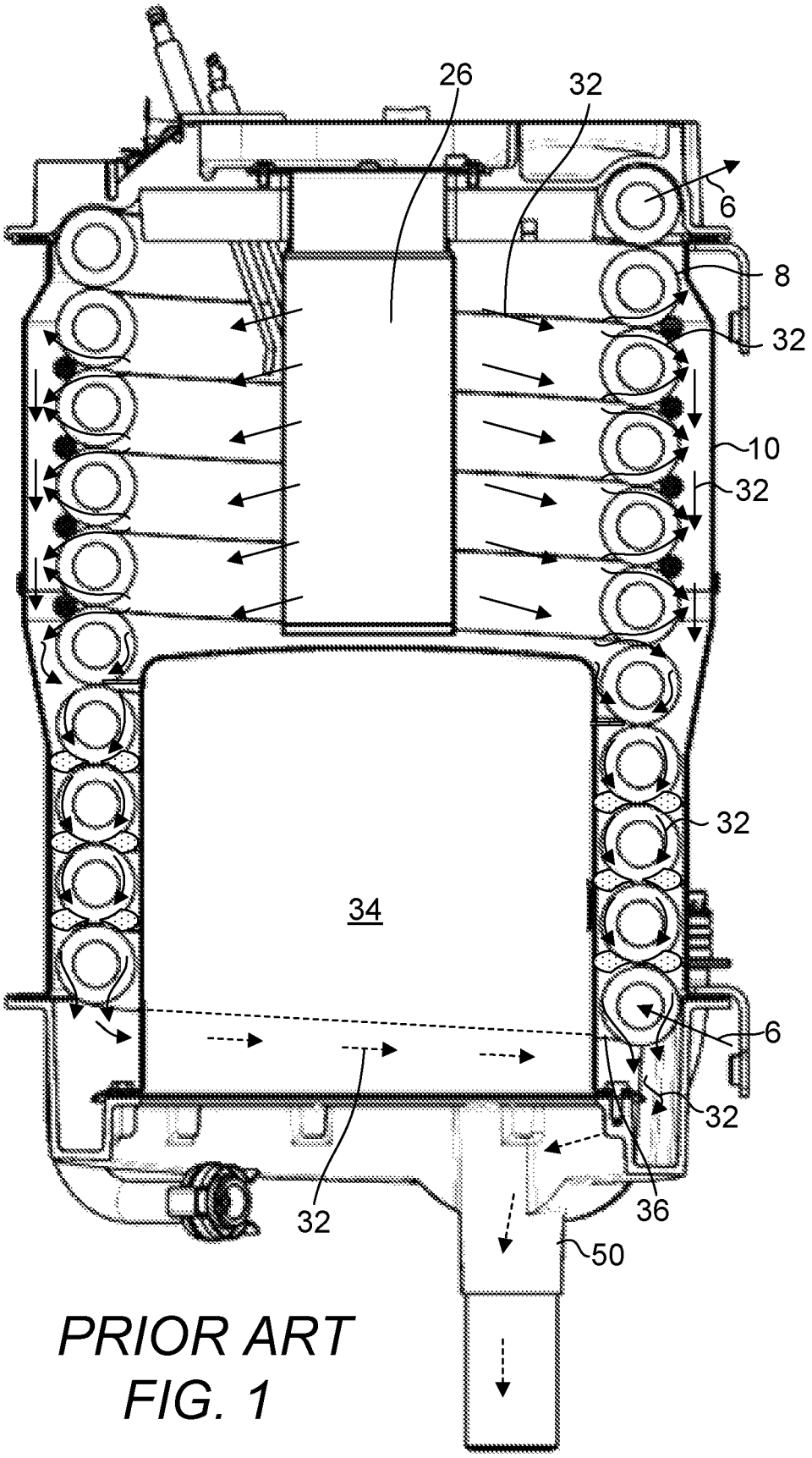
PRIOR ART FIG. 1
FIG. 1 depicts a prior art heat exchanger where a flue flow is configured to simply trace the bottom loop of the coil before exiting the heat exchanger to the exhaust of the heat exchanger.

FIG. 1 depicts a prior art heat exchanger where a flue flow is configured to simply trace the bottom loop of the coil before exiting the heat exchanger to the exhaust of the heat exchanger. It shall be noted that in the heat exchanger depicted, the flue flow 32, upon arriving at the last (bottom) loop 36 of the coil 8, tends to flow around it, before exiting at the bottom of the heat exchanger. Note that a structure 34 disposed within the lumen of the coil forces the flue flow around the coil 8 at the lower section of the coil 8. Upon leaving the last loop of the coil 8, the flue flow 32 no longer serves a purpose except only to continue to exit such that a flue flow can continue to occur. The additional distance for the flue flow 32 to trace increases the requirement of a blower with a higher capacity, e.g., a larger blower. Applicants discovered that by configuring the exit portion of the coil in the manner disclosed elsewhere herein, the pressure drop caused by an additional path caused by the last loop 36 of the coil 8 can be significantly reduced.

Figure 2:
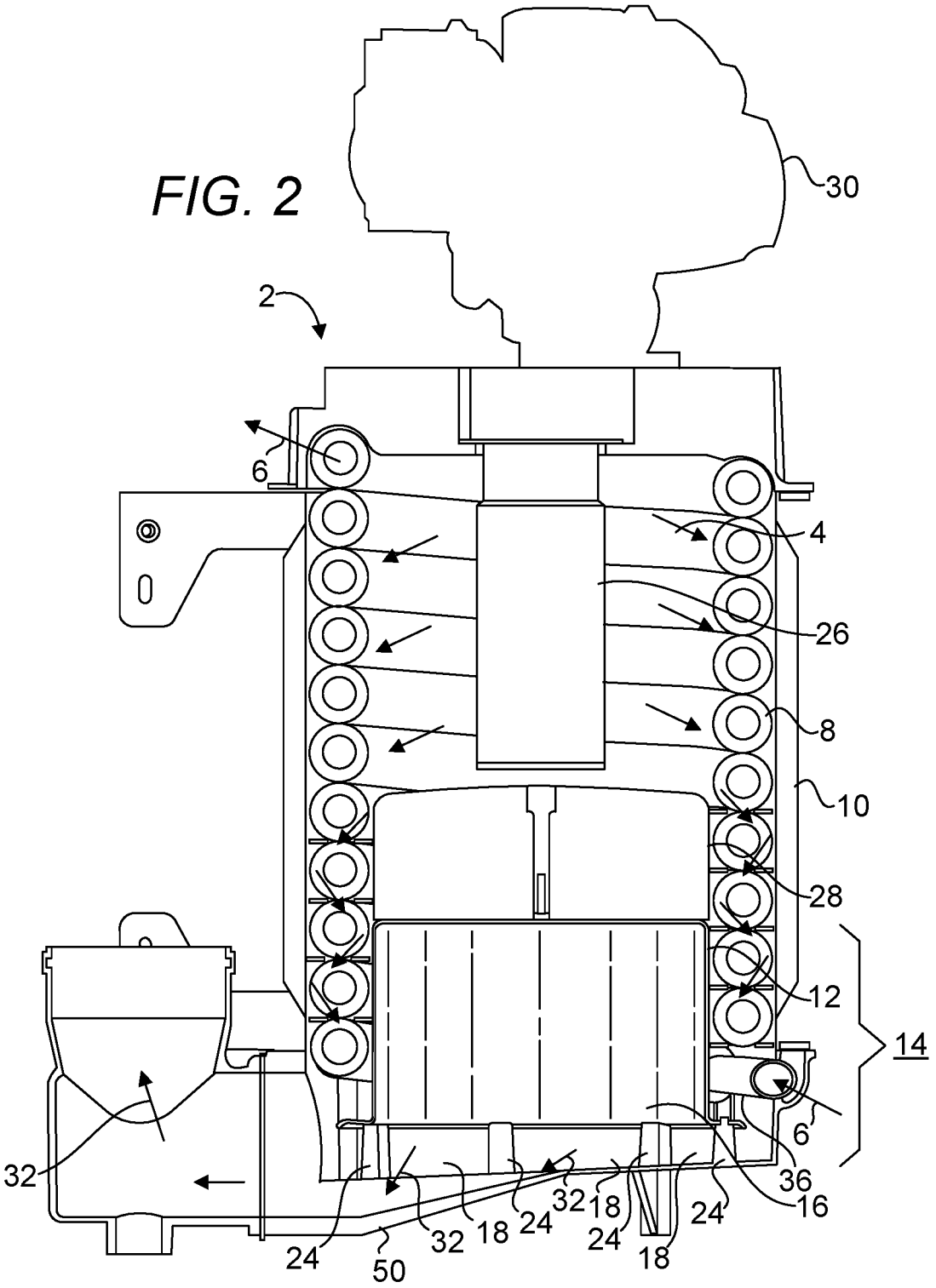
FIG. 2 is a side cross-sectional view of one embodiment of a present guide system, depicting a guide formed of a cylinder disposed atop a plurality of support legs where the guide system is seated within the lumen of a heat exchanger coil.
Figure 2A:
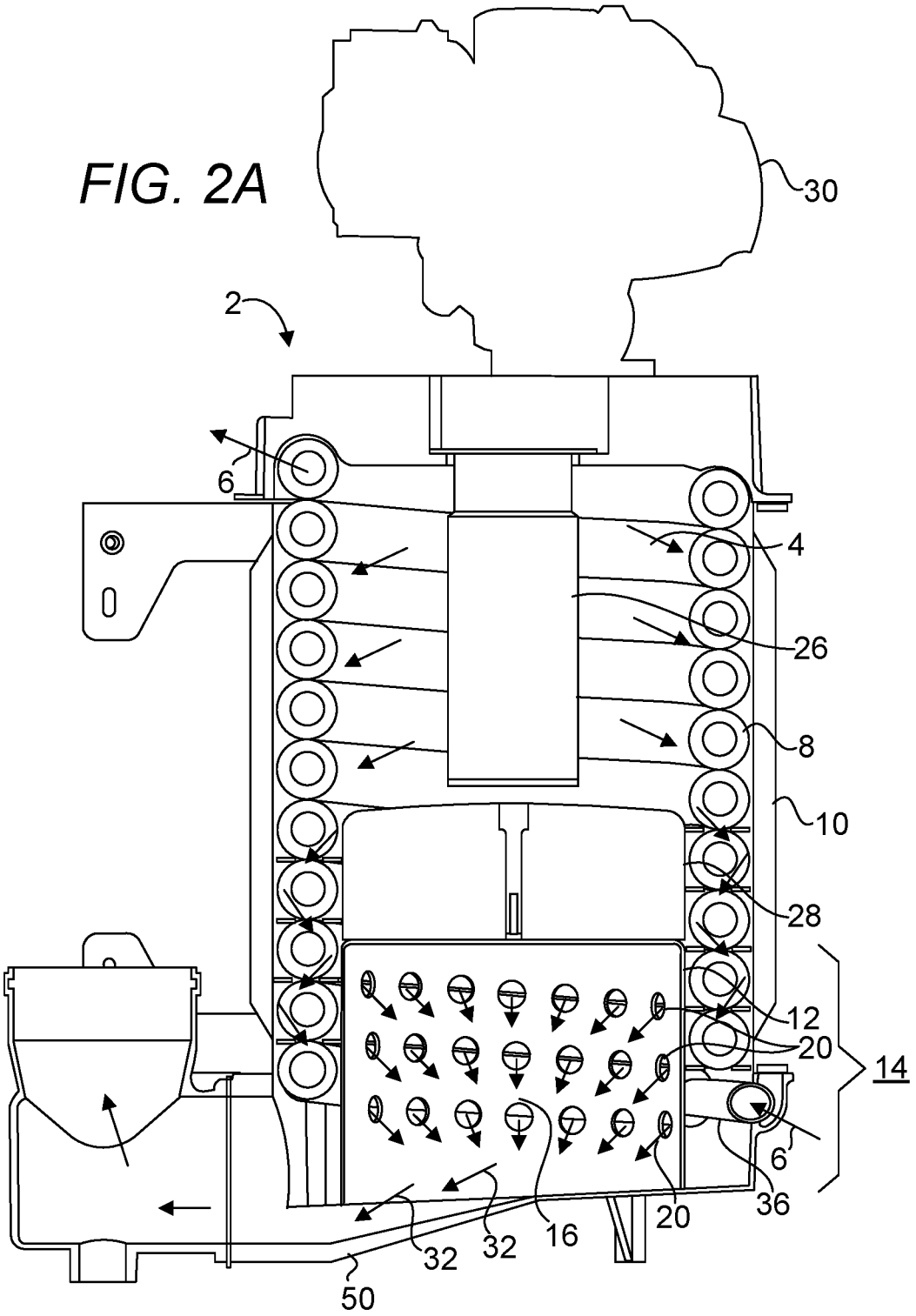
FIG. 2A is a side cross-sectional view of one embodiment of a present guide system, depicting a guide formed of a cylinder including a plurality of apertures, where the guide is seated within the lumen of a heat exchanger coil.

FIG. 2 is a side cross-sectional view of one embodiment of a present guide system, depicting a guide formed of a cylinder disposed atop a plurality of support legs disposed substantially about the bottom periphery of the guide where the guide system is seated within the lumen of a heat exchanger coil. It shall be noted that a plurality of openings 18 of the guide system 14 that are formed by disposing a closed-top tube 12 atop a plurality of legs 24 upon which the closed-top tube 12 is supported. Flue flow 32 can occur readily through the openings 18 into the lumen 16 of the guide system. FIG. 2A is a side cross-sectional view of one embodiment of a present guide system, depicting a guide formed of a cylinder including a plurality of apertures 20, where the guide is seated within the lumen of a heat exchanger coil.

Figure 3:
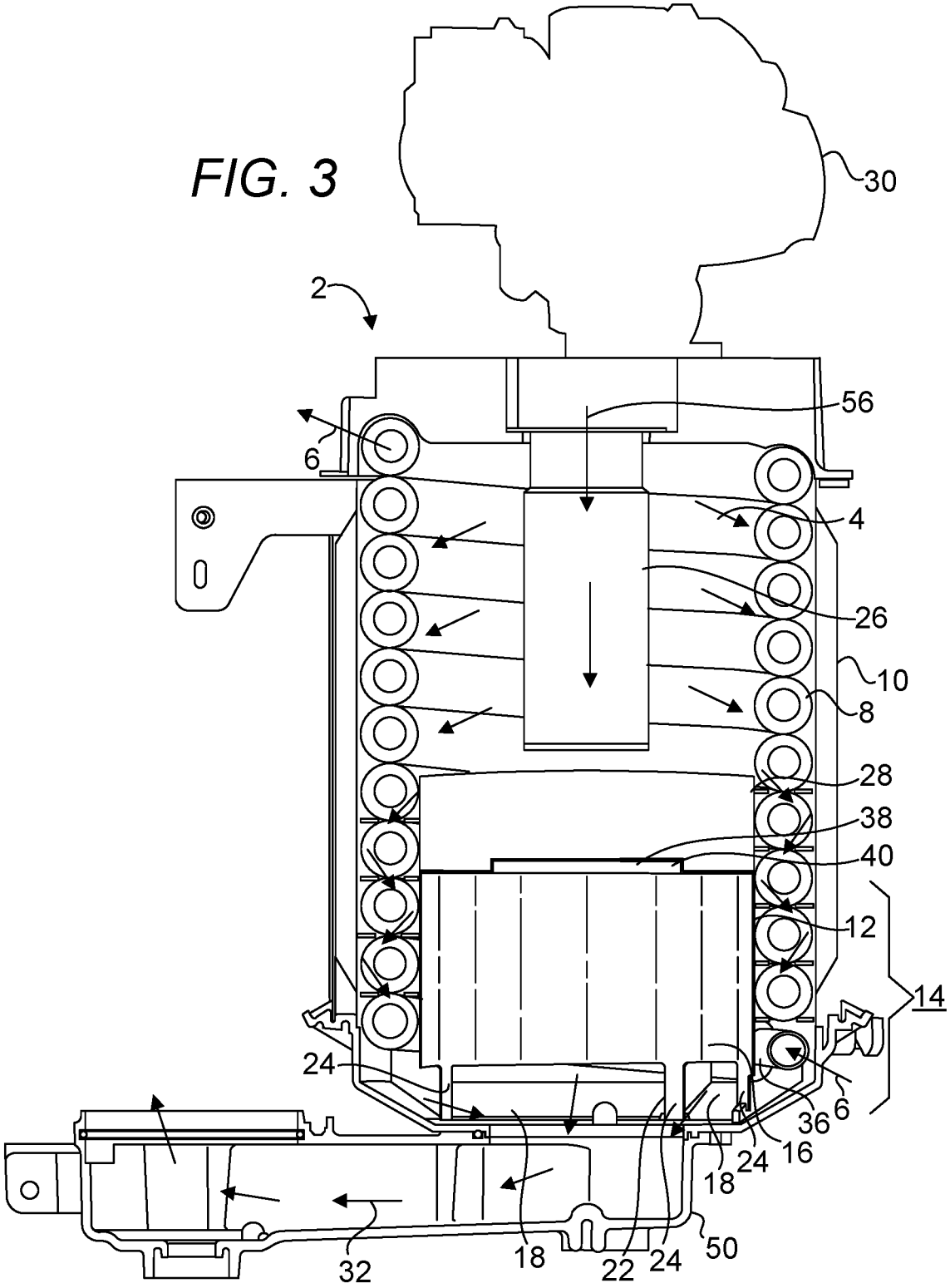
FIG. 3 is a side cross-sectional view of one embodiment of a present guide system, depicting a guide formed of a cylinder having a plurality of cutouts disposed on the bottom edge of the cylinder where the guide system is seated within the lumen of a heat exchanger coil.
Figure 4:
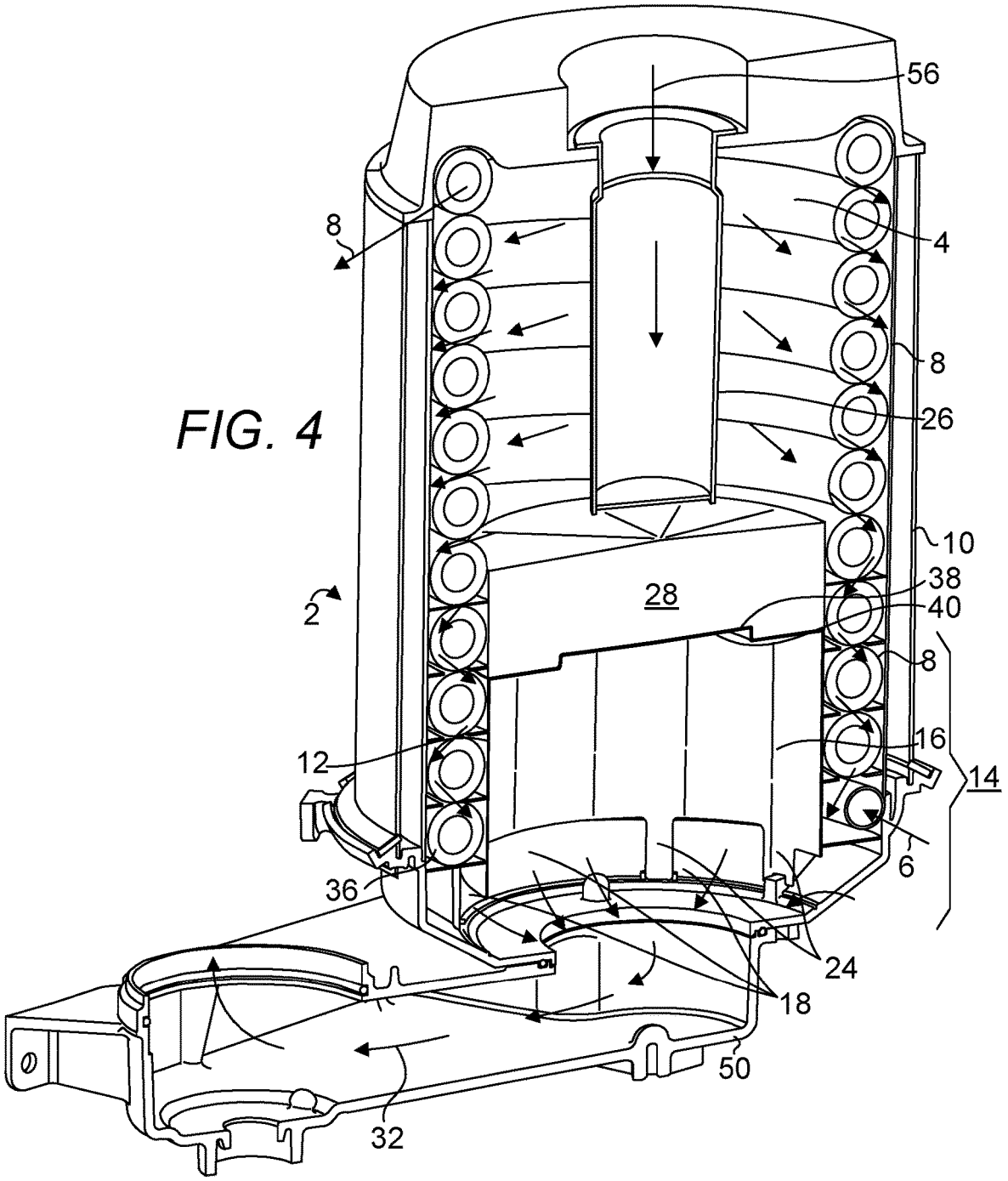
FIG. 4 is top perspective cross-sectional view of one embodiment of a present guide system, depicting a guide formed of a cylinder having a plurality of cutouts disposed on the bottom edge of the cylinder where the guide system is seated within the lumen of a heat exchanger coil.
Figure 5:
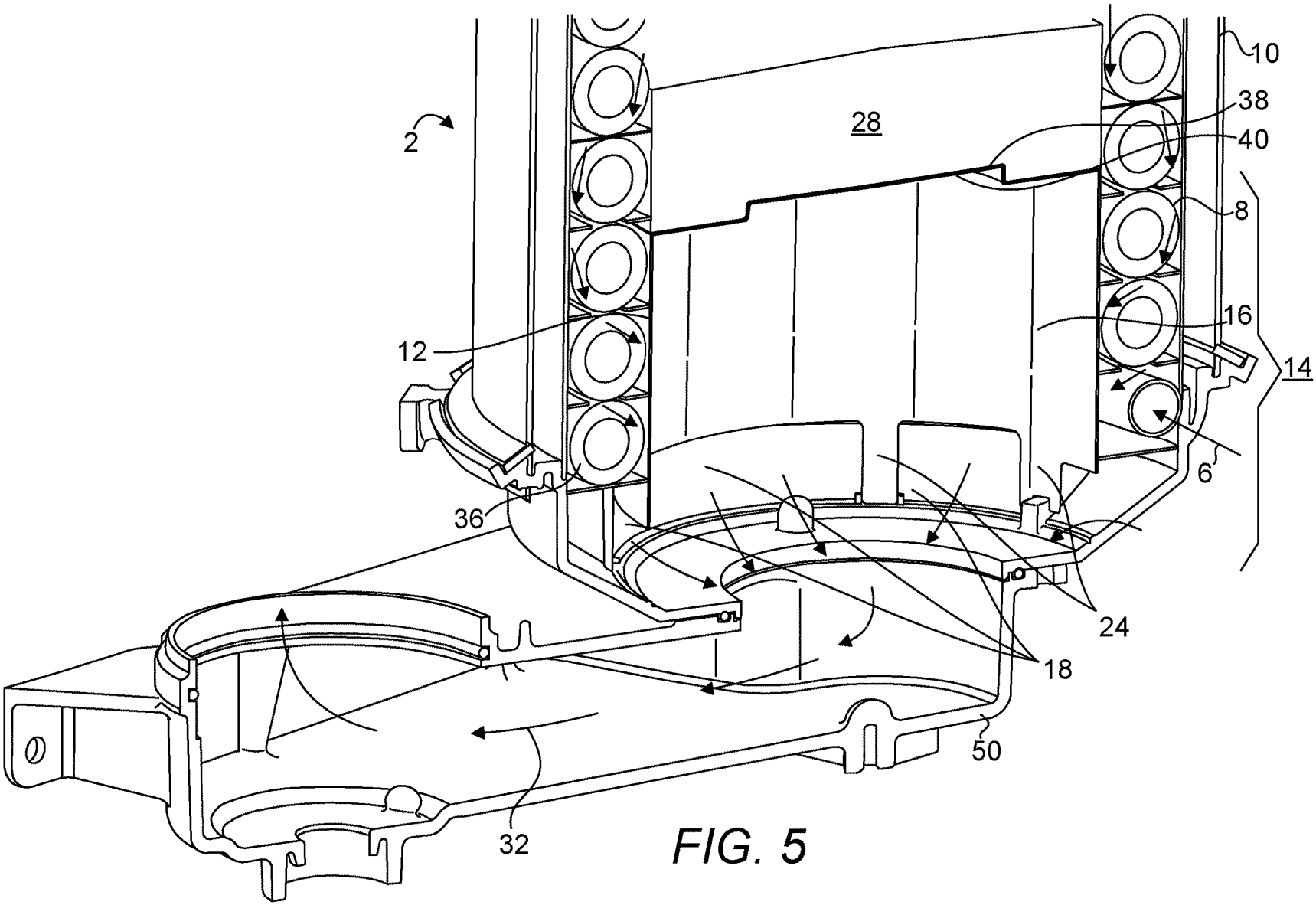
FIG. 5 is a top close-up perspective view of the embodiment of a present guide system shown in FIG. 3 where the guide system is seated within the lumen of a heat exchanger coil.

FIG. 3 is a side cross-sectional view of one embodiment of a present guide system 14, depicting a guide formed of a cylinder having a plurality of cutouts 22 disposed on the bottom edge of the cylinder where the guide system is seated within the lumen of a heat exchanger coil. FIG. 4 is top perspective cross-sectional view of one embodiment of a present guide system, depicting a guide formed of a cylinder having a plurality of cutouts disposed on the bottom edge of the cylinder where the guide system is seated within the lumen of a heat exchanger coil. FIG. 5 is a top close-up perspective view of the embodiment of a present guide system shown in FIG. 3 where the guide system is seated within the lumen of a heat exchanger coil.

Figure 6:
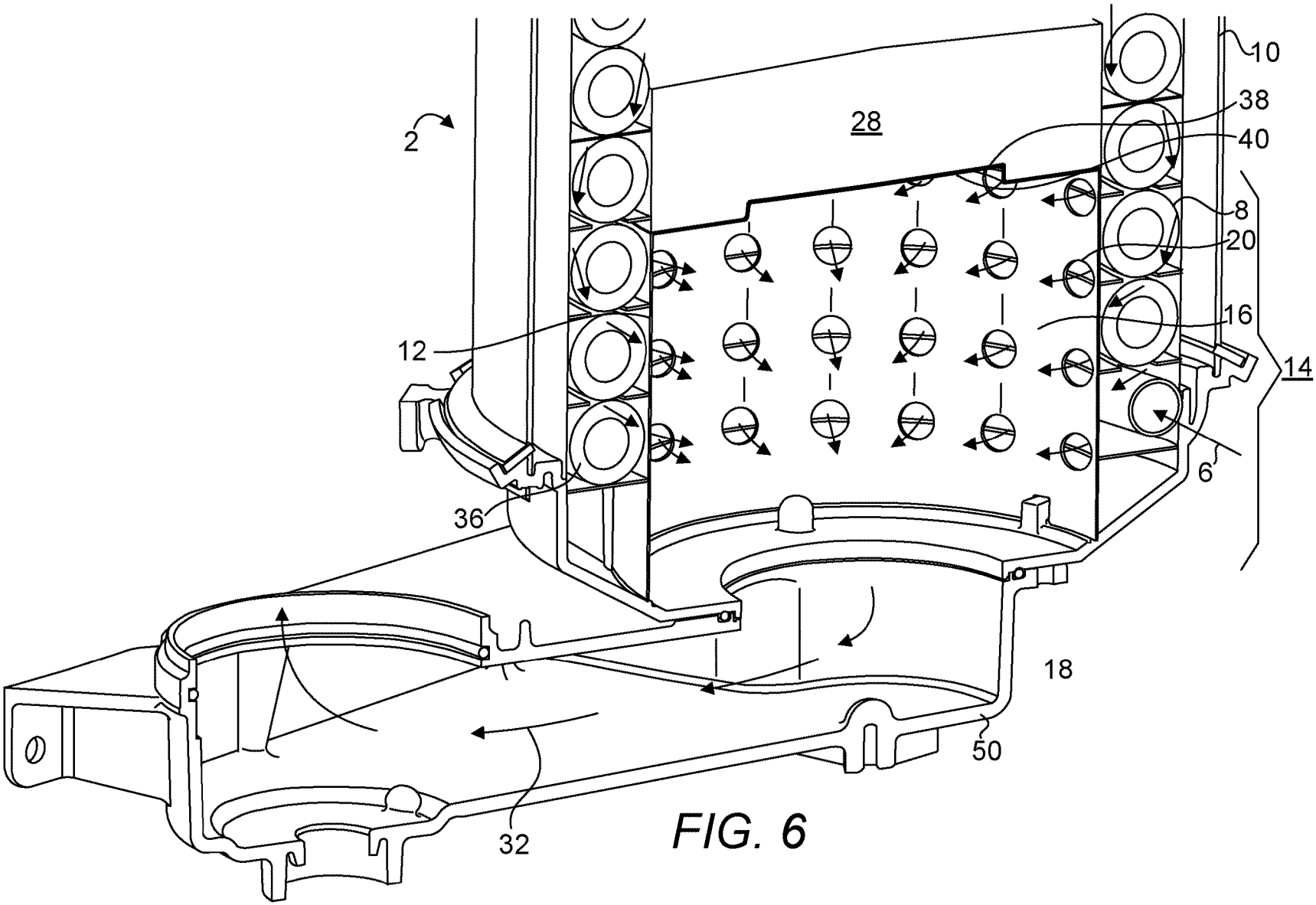
FIG. 6 is a top close-up perspective view of one embodiment of a present guide system, depicting a plurality of apertures disposed on a present guide system

FIG. 6 is a top close-up perspective view of one embodiment of the present guide system, depicting a plurality of apertures 20 disposed on a tube 12 of a present guide system. It shall be noted that the plurality of apertures 20 are disposed between the top end and the bottom end of the tube 12 for allowing the flue flow to enter the lumen of the guide system 14 from the flue path as represented by arrows upstream of the lumen of the tube 12. The plurality of apertures 20 are preferably aligned with an interface between at least one set of two consecutive coil loops of the coil 8 such that the flue flow 32 can flow more readily around the loops that span or encompassed across the height of the tube 12.

Figure 7:
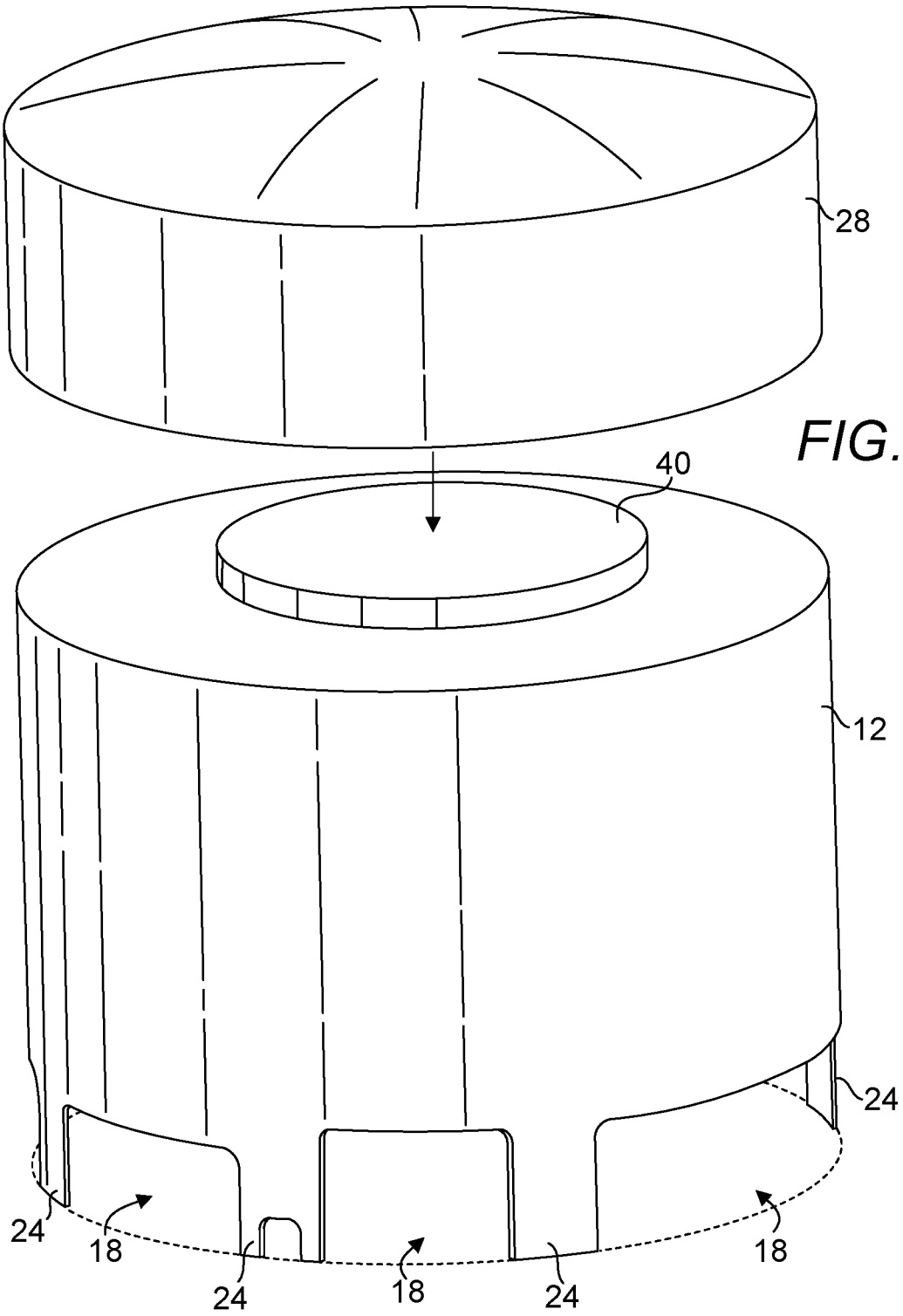
FIG. 7 is a top perspective view of one embodiment of a present guide system, depicting a manner in which a heat shield is coupled to the guide system.
Figure 8:
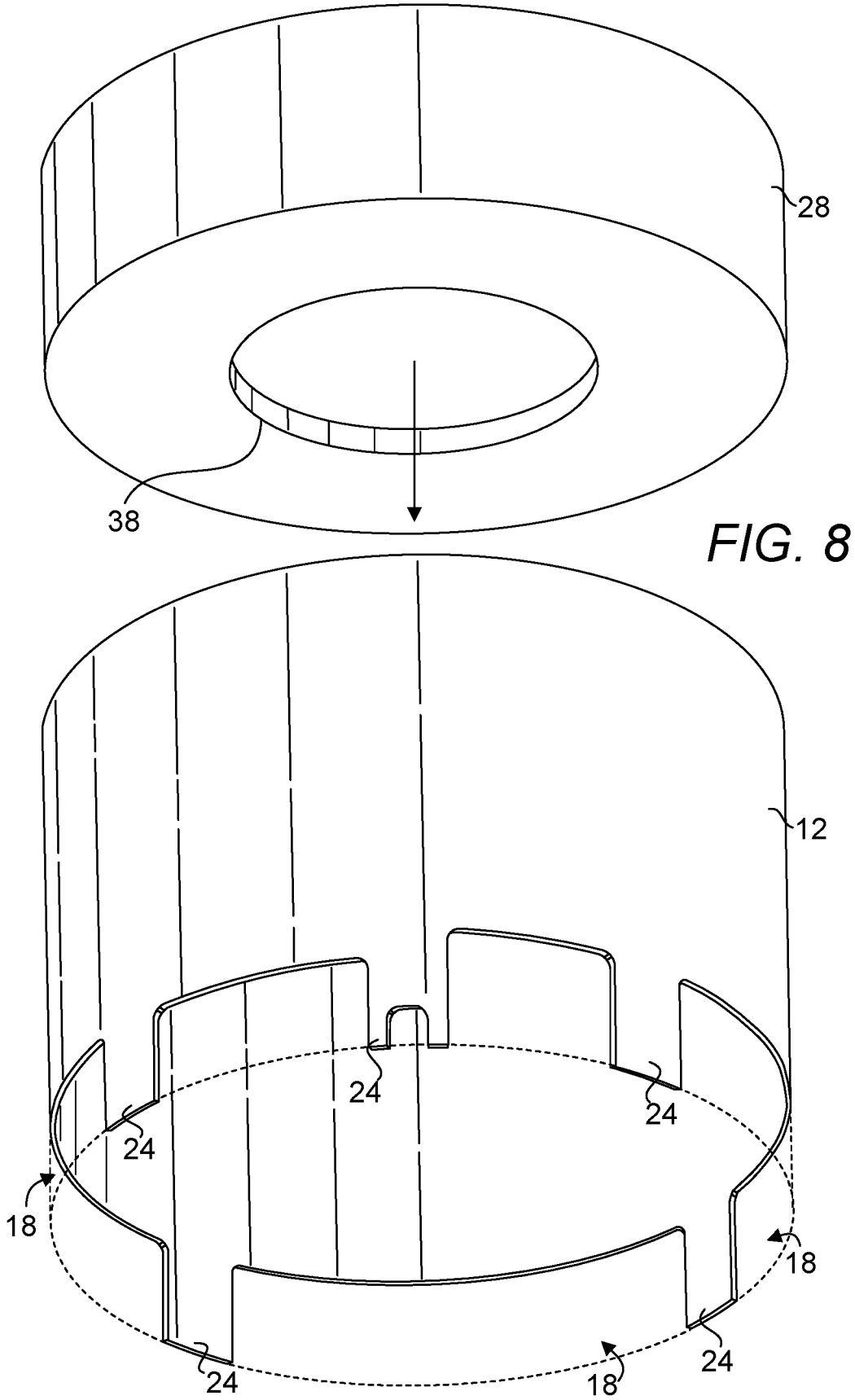
FIG. 8 is a bottom perspective view of one embodiment of a present guide system, depicting a manner in which a heat shield is coupled to the guide system.

FIG. 7 is a top perspective view of one embodiment of the present guide system, depicting a manner in which a heat shield is coupled to the guide system. FIG. 8 is a bottom perspective view of one embodiment of the present guide system, depicting a manner in which a heat shield is coupled to the guide system. Again, it shall be noted, in this embodiment, flue flow 32 can occur readily through the openings 18 into the lumen 16 of the guide system, reducing the pressure drop cause by the flue flow 32 through the coil 8 to the exhaust 50. FIGS. 3-5 depict a heat exchanger 2 for heating a fluid flow 6. Note that the blower which provides an air-fuel mixture flow 56 is not shown in FIG. 4. Upon combustion in a burner 26, the air-fuel mixture flow 56 becomes a flue flow 32 that continues around the coil 8 to eventually exit through the exhaust 50. The heat exchanger includes a coil 8, a burner 26, a housing 10 within which the coil 8 is disposed, an open-bottom and closed-top tube 12 and a guide system 14. The coil 8 includes a top section, a bottom section, a top end, a bottom end and a lumen. The coil is configured for receiving the fluid flow at one of the top end and bottom end of the coil and channeling the fluid flow to the other one of the top end and bottom end. In the example shown herein, the fluid flow 6 is received at the bottom end of the coil 8 and exits at the top end of the coil 8. The burner 26, disposed at the top section of the coil 8 within the lumen 4 of the coil 8, is configured to receive an air-fuel flow brought to it by a blower 30, urging a flue flow 32 of the burner 26 in a direction from the top end of the coil to the bottom end of the coil 8. The open-bottom and closed-top tube 12 is configured in a shape of the lumen 4 of the coil 8, e.g., cylinder, and is disposed at the bottom section within the lumen 4 of the coil 8 to cooperatively form a path with the housing 10 within which the bottom section of the coil is disposed. The guide system 14 includes a top end, a bottom end, a lumen 16 and a plurality of openings 18 and it is disposed within the lumen 4 at the bottom end of the coil 8 with the bottom end of the guide system 14 extending beyond the bottom end of the coil 8 in a direction from the top end of the coil to the bottom end of the coil 8. The guide system 14 is configured in a shape of the lumen 4 of the coil 8 and the plurality of openings 18 are disposed on the bottom end of the guide system 14. The heat exchanger 2 is configured to channel the flue flow 32 from the burner 26 through the path upstream of the guide to heat the flue flow 32 before entering the lumen of the guide system 14 via the plurality of openings 18 to avoid a pressure drop due to a tendency for the flue flow 32 to follow a route defined by a shape of the bottom end or the last loop 36 of the coil 8.

As shown in FIGS. 2-8, a heat shield 28, e.g., constructed from a ceramic material, is further disposed atop the tube 12 to prevent excessive heating that can occur on the top portion of the tube 12 at certain firing rates of the burner 26. In FIG. 2, the heat shield 28 is secured to the tube by means of a fastener. In FIGS. 3-8, the heat shield 28 can alternatively be secured to the tube 12 by means of a notch 38 and locator 40 pair to avoid the need of a fastener for securing the two parts. As shown in FIGS. 3-8, the notch 38 is disposed on a bottom surface of the heat shield 28 while its matching locator 40 is disposed on a top surface of the tube 12. A notch may alternatively be disposed on the tube 12 while its matching locator may be disposed on the heat shield 28 to achieve an equivalent coupling of the two parts.

Figure 9:
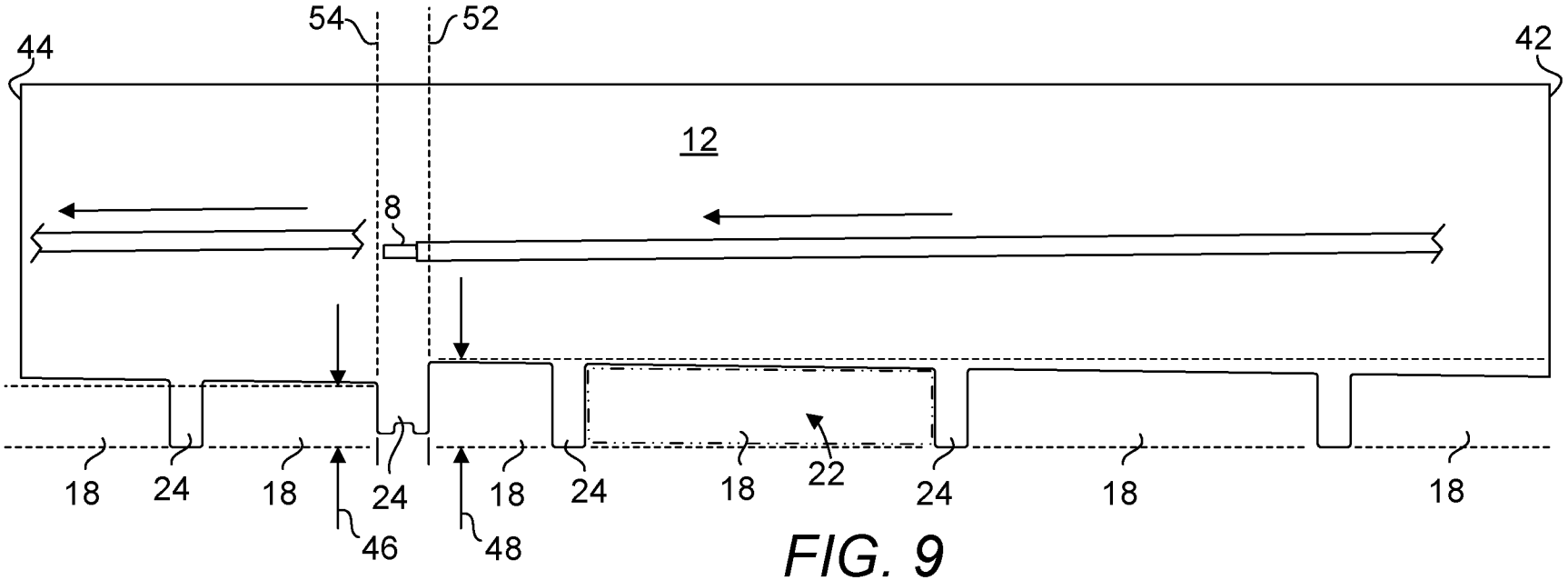
FIG. 9 is a diagram depicting the openings of a present guide system and their relationship with respect to the last loop of a heat exchanger coil.

FIG. 9 is a diagram depicting the openings of a present guide system and their relationship with respect to the last loop of a heat exchanger coil. In constructing a tube of a guide system, a sheet, e.g., a steel sheet having two edges 42, 44, is first provided. Openings 18 are subsequently cut out, e.g., by stamping, or laser cutting, etc., from the sheet before the sheet is rolled to form a tube and the edges 42, 44 joined, e.g., by welding and other joining techniques, etc., to form a physical seam that is subsequently smoothened. In one embodiment as shown in FIGS. 7-8, the top of the tube is further sealed using a circularly shaped plate that is embossed to form a locator. In one embodiment not shown, the tube is configured to receive a heat shield atop the tube which also serves to seal the top end of the tube. In balancing the pressure drop of a flue flow along the periphery of the tube, the plurality of openings 18 are configured to vary in size along a periphery of the bottom end of the guide system. As the last loop of the coil 8 winds towards the end of the coil 8, the space between the coil 8 and the exhaust 50 decreases. Therefore, in order to maintain a balanced flue flow 32 across the openings 18, the size of the openings 18 is configured to increase as the last loop of the coil 8 winds towards the tip of the coil 8. In FIG. 9, a portion of coil 8 is shown laid flat and superimposed over the sheet to show the relationship between the coil 8 and the tube 12. For instance, the average height 46 of the openings 18 at the left seam 54 of the sheet increases to the average height 48 of the openings 18 at the right seam 52 of the sheet as the last loop of the coil 8 winds towards the end of the coil 8.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A heat exchanger for heating a fluid flow, said heat exchanger comprising:

(a) a coil comprising a top section, a bottom section, a top end, a bottom end and a lumen, said coil configured for receiving the fluid flow at one of said top end and bottom end of said coil and channeling the fluid flow to the other one of said top end and bottom end;

(b) a burner disposed at said top section within said lumen of said coil, said burner configured to receive an air-fuel flow urging a flue flow of said burner in a direction from said top end of said coil to said bottom end of said coil;

(c) a housing within which said coil is disposed;

(d) an open-bottom and closed-top tube configured in a shape of said lumen of said coil, said closed-top tube disposed at said bottom section within said lumen of said coil to cooperatively form a path with said housing within which said bottom section of said coil is disposed, wherein said closed-top tube further comprises a locator on a top portion of said closed-top tube, said locator is configured to be mated to a notch of a heat shield for securing the heat shield atop said closed-top tube; and (e) a guide system comprising a top end, a bottom end, a lumen and a plurality of openings, said guide system disposed within said lumen of said coil at said bottom end of said coil with said bottom end of said guide system extending beyond said bottom end of said coil in a direction from said top end of said coil to said bottom end of said coil, wherein said guide system is configured in a shape of said lumen of said coil and said plurality of openings are disposed on said bottom end of said guide system and at least two of said plurality of openings are different in size, wherein said heat exchanger is configured to channel the flue flow from said burner through said path to heat the fluid flow before entering said lumen of said guide system via said plurality of openings to avoid a pressure drop due to a tendency for the flue flow to follow a route defined by a shape of said bottom end of said coil.

2. The heat exchanger of claim 1, wherein said plurality of openings of said guide system comprises at least one cutout made on said bottom end of said guide system.

3. The heat exchanger of claim 1, wherein said plurality of openings of said guide system comprises at least one leg upon which said closed-top tube is supported.

4. The heat exchanger of claim 1, wherein the heat shield comprises a ceramic material.

5. A heat exchanger for heating a fluid flow, said heat exchanger comprising:

(a) a coil comprising a top section, a bottom section, a top end, a bottom end and a lumen, said coil configured for receiving the fluid flow at one of said top end and bottom end of said coil and channeling the fluid flow to the other one of said top end and bottom end;

(b) a burner disposed at said top section within said lumen of said coil, said burner configured to receive an air-fuel flow urging a flue flow of said burner in a direction from said top end of said coil to said bottom end of said coil;

(c) a housing within which said coil is disposed;

(d) an open-bottom and closed-top tube configured in a shape of said lumen of said coil, said closed-top tube disposed at said bottom section within said lumen of said coil to cooperatively form a path with said housing within which said bottom section of said coil is disposed;

(e) a guide system comprising a top end, a bottom end, a lumen and a plurality of openings, said guide system disposed within said lumen of said coil at said bottom end of said coil with said bottom end of said guide system extending beyond said bottom end of said coil in a direction from said top end of said coil to said bottom end of said coil, wherein said guide system is configured in a shape of said lumen of said coil and said plurality of openings are disposed on said bottom end of said guide system; and (f) a heat shield disposed atop said closed-top tube to prevent overheating of a top portion of said closed-top tube, wherein said heat shield is configured to be coupled to said closed-top tube by a notch-locator pair to remove the need of a fastener for coupling said closed-top tube to said heat shield, wherein said heat exchanger is configured to channel the flue flow from said burner through said path to heat the fluid flow before entering said lumen of said guide system via said plurality of openings to avoid a pressure drop due to a tendency for the flue flow to follow a route defined by a shape of said bottom end of said coil.

6. A heat exchanger for heating a fluid flow, said heat exchanger comprising:

(a) a coil comprising a top section, a bottom section, a top end, a bottom end and a lumen, said coil configured for receiving the fluid flow at one of said top end and bottom end of said coil and channeling the fluid flow to the other one of said top end and bottom end;

(b) a burner disposed at said top section within said lumen of said coil, said burner configured to receive an air-fuel flow urging a flue flow of said burner in a direction from said top end of said coil to said bottom end of said coil;

(c) a housing within which said coil is disposed;

(d) an open-bottom and closed-top tube configured in a shape of said lumen of said coil, said closed-top tube disposed at said bottom section within said lumen of said coil to cooperatively form a path with said housing within which said bottom section of said coil is disposed, wherein said closed-top tube further comprises a locator on a top portion of said closed-top tube, said locator is configured to be mated to a notch of a heat shield for securing the heat shield atop said closed-top tube; and (e) a guide system comprising a top end, a bottom end, a lumen and a plurality of openings, said guide system disposed within said lumen of said coil at said bottom end of said coil with said bottom end of said guide system extending beyond said bottom end of said coil in a direction from said top end of said coil to said bottom end of said coil, wherein said guide system is configured in a shape of said lumen of said coil and said plurality of openings are disposed on said bottom end of said guide system, wherein said heat exchanger is configured to channel the flue flow from said burner through said path to heat the fluid flow before entering said lumen of said guide system via said plurality of openings to avoid a pressure drop due to a tendency for the flue flow to follow a route defined by a shape of said bottom end of said coil.

7. A guide system for guiding a flue flow of a heat exchanger configured for heating a fluid flow, the heat exchanger having a coil having a top section, a bottom section, a top end, a bottom end and a lumen, the coil configured for receiving the fluid flow at one of the top end and bottom end of the coil and channeling the flow to the other one of the top end and bottom end, a burner disposed at the top section of the coil within the lumen of the coil, the burner configured to receive an air-fuel flow urging a flue flow of the burner in a direction from the top end of the coil to the bottom end of the coil, a housing within which the coil is disposed, an open-bottom and closed-top tube configured in a shape of the lumen of the coil, the closed-top tube disposed at the bottom section of the coil within the lumen of the coil to cooperatively form a path with the housing within which the bottom section of the coil is disposed, said guide system comprising:

a top end, a bottom end, a lumen and at least one aperture, said guide system is disposed within the lumen of the coil at the bottom end of the coil with said bottom end of said guide system extending beyond the bottom end of the coil in a direction from the top end of the coil to the bottom end of the coil, said guide system is configured in a shape of the lumen of the coil and said at least one aperture disposed between said top end and said bottom end of said guide system for allowing the flue flow to enter said lumen of said guide system from the path, wherein the heat exchanger is configured to channel the flue flow from the burner through the path to heat the fluid flow before entering the lumen of said guide system via said at least one aperture to avoid a pressure drop due to a tendency for the flue flow to follow a route defined by a shape of the bottom end of the coil.

8. The guide system of claim 7, the coil having a plurality of coil loops, said at least one aperture is aligned with an interface between at least one set of two consecutive coil loops of the coil.

9. A heat exchanger for heating a fluid flow, said heat exchanger comprising:

(a) a coil comprising a top section, a bottom section, a top end, a bottom end and a lumen, said coil configured for receiving the fluid flow at one of said top end and bottom end of said coil and channeling the fluid flow to the other one of said top end and bottom end;

(b) a burner disposed at said top section within said lumen of said coil, said burner configured to receive an air-fuel flow urging a flue flow of said burner in a direction from said top end of said coil to said bottom end of said coil;

(c) a housing within which said coil is disposed;

(d) an open-bottom and closed-top tube configured in a shape of said lumen of said coil, said closed-top tube disposed at said bottom section within said lumen of said coil to cooperatively form a path with said housing within which said bottom section of said coil is disposed;

(e) a guide system comprising a top end, a bottom end, a lumen and a plurality of openings, said guide system disposed within said lumen of said coil at said bottom end of said coil with said bottom end of said guide system extending beyond said bottom end of said coil in a direction from said top end of said coil to said bottom end of said coil, wherein said guide system is configured in a shape of said lumen of said coil and said plurality of openings are disposed on said bottom end of said guide system and at least two of said plurality of openings are different in size; and (f) a heat shield disposed atop said closed-top tube to prevent overheating of a top portion of said closed-top tube, wherein said heat shield is configured to be coupled to said closed-top tube by a notch-locator pair to remove the need of a fastener for coupling said closed-top tube to said heat shield, wherein said heat exchanger is configured to channel the flue flow from said burner through said path to heat the fluid flow before entering said lumen of said guide system via said plurality of openings to avoid a pressure drop due to a tendency for the flue flow to follow a route defined by a shape of said bottom end of said coil.

10. The heat exchanger of claim 9, wherein said plurality of openings of said guide system comprises at least one cutout made on said bottom end of said guide system.

11. The heat exchanger of claim 9, wherein said plurality of openings of said guide system comprises at least one leg upon which said closed-top tube is supported.

* * * * *